United States Patent [19]

Shadwick

[11] Patent Number: 4,523,868

[45] Date of Patent: Jun. 18, 1985

[54] RIBBON FEED CARTRIDGE

[75] Inventor: David T. Shadwick, Versailles, Ky.

[73] Assignee: International Business Machines Corporation, Armonk, N.Y.

[21] Appl. No.: 514,407

[22] Filed: Jul. 18, 1983

[51] Int. Cl.[3] ..... B41J 35/28

[52] U.S. Cl. ..... 400/208; 400/196

[58] Field of Search ..... 400/207, 208, 208.1, 400/194, 196, 195; 242/197, 198, 199, 200

[56] References Cited

U.S. PATENT DOCUMENTS

| | | | |
|---|---|---|---|
| 3,889,795 | 7/1975 | Garberi et al. | 400/208 |
| 4,082,210 | 4/1978 | Gottschlich | 400/208 X |
| 4,088,218 | 5/1978 | Depew | 400/208 |
| 4,299,504 | 11/1981 | Benz et al. | 400/208 |
| 4,302,118 | 11/1981 | Schaefer . | |
| 4,317,636 | 3/1982 | Hume | 400/208 |
| 4,339,210 | 7/1982 | Craft et al. | 400/208 |
| 4,347,007 | 8/1982 | Schaefer | 400/208 |
| 4,350,451 | 9/1982 | Furrow | 400/208 |
| 4,367,052 | 1/1983 | Steger | 400/208 |

FOREIGN PATENT DOCUMENTS

| | | | |
|---|---|---|---|
| 0035771 | 9/1981 | European Pat. Off. | 400/208 |
| 0041095 | 12/1981 | European Pat. Off. . | |
| 0045565 | 2/1982 | European Pat. Off. . | |
| 3109926 | 9/1982 | Fed. Rep. of Germany . | |

*Primary Examiner*—Edgar S. Burr
*Assistant Examiner*—James R. McDaniel
*Attorney, Agent, or Firm*—Laurence R. Letson

[57] ABSTRACT

The feeding of typewriter ribbons is improved by utilizing a cartridge carried driving element engaging the periphery of a translatable take-up spool where the driving element is driven by an interface connection with a driving member connected either directly or through a gear reduction train to a stepper motor. The simplified ribbon feed mechanism provides control over the increment of feed electronically as well as each ribbon cartridge carrying the appropriate gear reductions, if necessary, for different types of ribbons.

5 Claims, 6 Drawing Figures

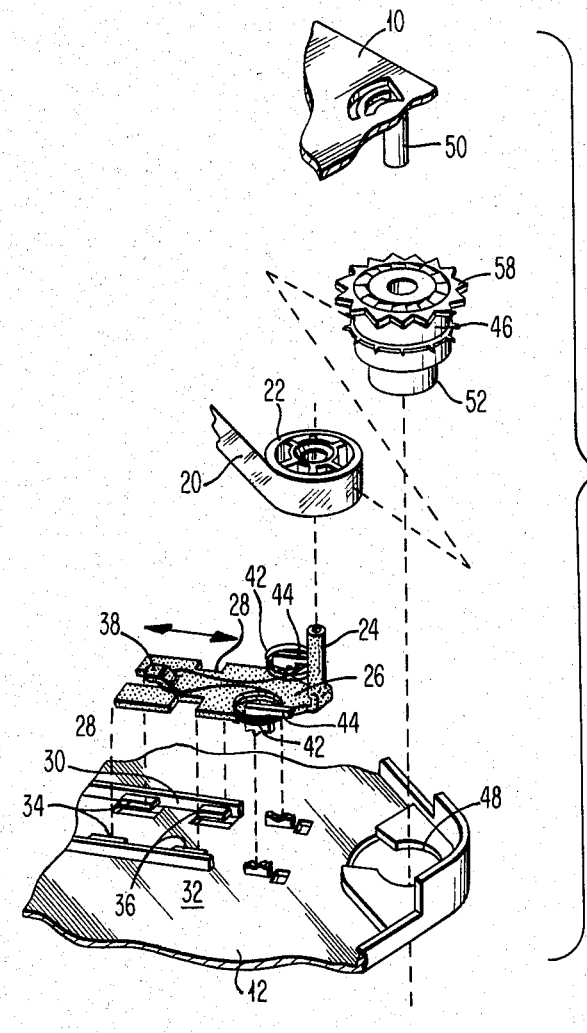
FIG. 4
FIG. 5
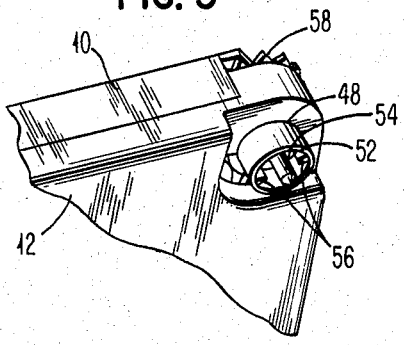
FIG. 6
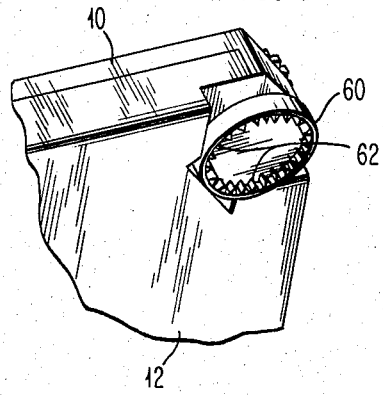

RIBBON FEED CARTRIDGE

DESCRIPTION OF THE INVENTION

Technical Field

This invention relates to cartridges for holding and feeding ribbon for use in typewriters.

Background of the Invention

The feeding of typewriter ribbons in cartridges requires several things. The requirements range from the need for a mechanical mechanism which can be inserted into the cartridge or to engage the cartridge for feeding, which may become quite complex but which must be reliable, to the requirement that the drive mechanism be engaged with the periphery of the takeup spool in order to insure uniform feed of the ribbon to minimize ribbon waste, to cartridges which accommodate the mechanical feed drive and the engagement of the drive with the ribbon periphery.

With the addition of correction capability to a typewriter and the packaging of the correction media, tapes or ribbons, in cartridges, the complexity of ribbon drives and the associated complexity of cartridges has increased. It is necessary to be able to feed the ribbon in the ribbon cartridge without interfering with the correction media cartridge position or operation.

Electrical motor drives for feeding ribbon have increased with the reduction of the mechanical complexity of the print carrier of typewriters as the technology tends to move toward the daisy wheel type printer making room for the mass and size of the electrical motors, typically stepper motors, for ribbon feed. Electrical motors provide a number of advantages in that a stepper motor may then be commanded to provide either a variable amount of feed, depending upon the pitch of the type being typed, or may even provide a variable amount of feed within a single character set depending on the width of the characters in proportionally spaced printing. The use of electric motor drive such as a stepping motor requires that a fixed location be defined so that the cartridge may interface with the motor drive at a fixed point.

With a fixed interface point, a peripheral drive of the takeup spool necessitates the displaceability of the takeup spool to accommodate an increasing diameter of ribbon as the spool accumulates the used ribbon while insuring uniform feed increment of the ribbon during operation. Displaceable takeups must be, of necessity, simple, reliable and relatively inexpensive to be cost effective since the cartridges are designed to be disposable.

An example of a ribbon cartridge which has a moveable takeup spool but which does not have the ribbon spool drive member positioned within and a part of the cartridge is U.S. Pat. No. 4,302,118 to Schaefer, while a spring improvement for providing the bias force of the takeup spool against the driver and providing a yield in the spring with a flat rate force is described in U.S. Pat. No. 4,367,052 to Steger.

While both of these patents illustrate a moveable takeup spool to accommodate increased ribbon bulk as it is wound on the spool, neither one of these patents illustrates a cartridge which has a self-contained drive element engaged with the takeup spool and neither of the patents illustrates a spool carrier which has a stabilizing plane engaging a planar surface of the cartridge, thus minimizing the possibility of misalignment of the takeup spool and a diminished usage of the cartridge and its contained ribbon.

SUMMARY OF THE INVENTION

The advantages of the motor direct drive ribbon feed, such as the ease in directly connecting the cartridge to the drive, uniformity of ribbon feed, simplicity of the ribbon feed mechanism, and the ability to control the increment of feed are available by supporting a takeup spool on a spool carrier contained within the ribbon cartridge and adapting the spool carrier to slide within a predefined guiding channel in the cartridge. The carrier may slide to displace the takeup spool from the driver to accommodate a larger diameter disk of ribbon as it is accumulated on the takeup spool while the carrier takeup spool and ribbon disk are uniformly biased throughout its range of travel by a spring which exerts a constant force on the carrier.

Ribbon drive is provided by a spiked driver member which is meshed with takeup spool with the rate of feed fixed by the cartridge. The cartridge determines the rate of feed by the design of the receptacle which receives and engages the motor drive connection. Direct drive from the motor shaft to the spiked driver is used for a one time use ribbon while a planetary gear drive arrangement is used for multi-strike ribbon.

BRIEF DESCRIPTION OF DRAWINGS

FIG. 4 is an exploded isometric view of the ribbon feed drive mechanism and carrier for the takeup spool;

FIG. 5 is an isometric bottom view of the drive connection shown in FIG. 2; and FIG. 6 is a bottom isometric view of the drive connection shown in FIG. 3.

DETAILED DESCRIPTION OF THE INVENTION

Figure 1:
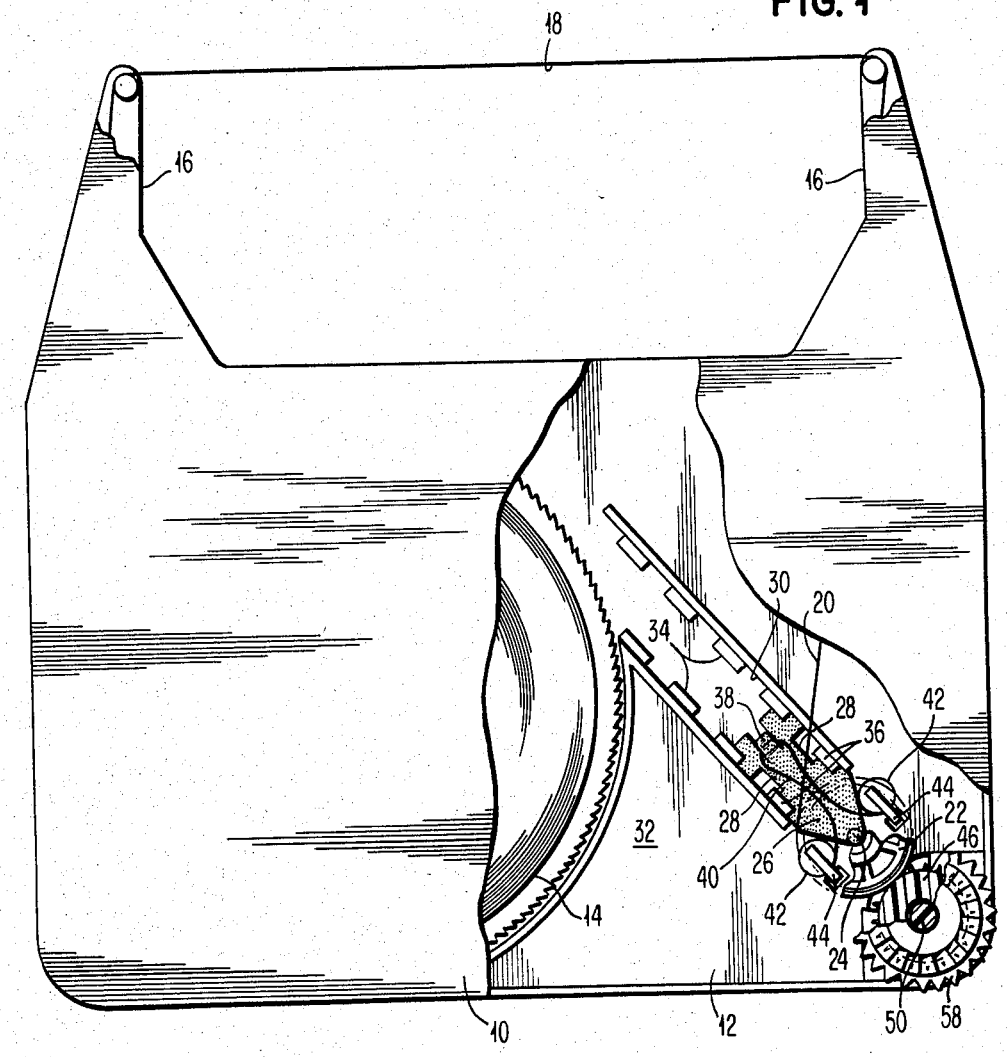
FIG. 1 is a partially cutaway top view of a ribbon cartridge incorporating the ribbon feed mechanism of the invention.

Referring to the drawing, the ribbon cartridge 10 is illustrated. The cartridge 10 defines an interior chamber 12 which may contain a spool of ribbon 14. Extending outwardly from the cartridge are two arms 16 which support a span 18 of ribbon 20.

In order to take up the used ribbon 20, a takeup spool 22 is provided. In this particular instance, in FIG. 1, the takeup spool is cut away to a significant extent to expose and reveal other details of the cartridge.

Takeup spool 22 rotates on a short stub axle 24. Stub axle 24 is formed as a part of or attached to the spool carrier 26. Spool carrier 26 is formed as a flat planar member which has, in the preferred embodiment, notches 28 formed in the side thereof to aid in inserting the member into channel 30. Channel 30 is molded into the cartridge wall 32 and has formed therein tabs 34 which act to restrain the carrier 26 and contain its movement within the channel. Notches 28 are dimensioned such that the notch 28 will pass over tabs 36. The carrier 26 has formed into its end a tab 38 which is raised to permit the hooking of a spring 40 thereunder.

Spring 40 is formed by sharply bending a spring wire at its approximate midpoint to form two legs and then winding the ends of the wire into counter wound coils 42. Coils 42 are then engageable over molded hook restraints 44 formed as a part of the floor 32 of cartridge 10.

In positioning the spring 40, as shown in FIG. 1, the coils 42 must be partially unwound to hook over the restraints 44 and therefore resiliently act to recoil themselves and thereby move the carrier 26 and axle 24 toward the spiked driver 46. The spiked driver 46 is a cylindrical drive roller with sharp protrusions extending therefrom and engageable peripherally with the exterior of the takeup spool 22 or any ribbon wound thereon. The spiked driver is provided with a drive connection 52 which is supported in a journal surface 48 while the opposite end of the spiked driver 46 is supported by a small positioning shaft 50. The connection 52 is formed as a shell of a cylinder with a locating shaft 54 protruding coaxially with the shell and two spline members 56 formed in the outer shell of the connection 52. A gear or mating splined member is positionable over shaft 54 and engaging the splines 56 to provide the drive from the motor to the connection 52 and thence to the spiked driver 46. Associated with the spiked driver 46, either manufactured as a part thereof or attached and fixedly held thereto, is a knurled wheel 58. The knurling on the wheel 58 provides a finger engageable surface so that the ribbon takeup spool 22 may be rotated to accumulate any slack in the span 18 of the ribbon 20.

Figure 2:
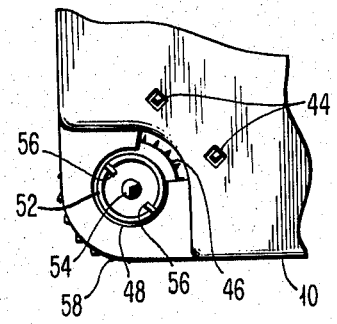
FIG. 2 is a bottom view of a drive connection to the ribbon feed driver.

The connection 52 illustrated in FIG. 2 provides a one-to-one ratio of drive between the motor shaft rotation or the driving gear rotation and the spiked driver 46. This driving ratio is the desired condition for a single use type ribbon.

Figure 3:
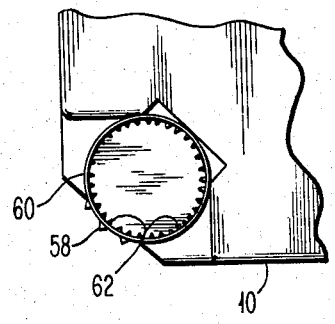
FIG. 3 is a bottom view of an alternative embodiment of the drive connection to the ribbon feed driver.

For multiple strike ribbons which permit a plurality of typing impact overlapped, the driving connection 60 illustrated in FIG. 3 is desirable. The driving connection 60 is a larger diameter cup with splines 62 formed on the interior cylindrical surface of the connection 60. A gear with appropriate spaced splines or teeth may be meshed with the splines 62 and will thus act as a planetary gear reduction system whereby the spiked driver 46, to which connection 60 is connected, will rotate a fraction of a revolution for each revolution of the motor shaft.

Referring again to the spring 40, as the spring member is extended by the translation of carrier 26 and axle 24 in response to an accumulation of used ribbon 20 on takeup spool 22, the coils 42 will be uncoiled. This uncoiling action will, of course, result in a force being exerted at the midpoint of the spring attempting to pull the carrier 26 against the direction it is being moved by the ribbon. As this force increases and the translation distance of the carrier increases, the coils 42 will continue to unwind. The material of the spring, a spring wire, is selected in size and properties to provide a relatively low elastic limit such that as the coil is uncoiled, the elastic limit of the material is exceeded and the tendency to attempt to recoil is reduced. This selection of the elastic limit tends to make the spring exert a constant force against slider 26 without regard to the amount of the distance that the slider has been displaced and the degree of uncoiling of the coils. Thus, the force exerted between the takeup spool 22 and the spiked driver 46 will remain substantially constant throughout the useful life of the cartridge.

OPERATION

The cartridge is operated by positioning it into an appropriate holder and insuring that the drive connection 52 or 60 is appropriately positioned over the drive gear of the ribbon feed mechanism which is powered by an electrical drive motor such as a stepping motor. The ribbon feed mechanism, upon activation, will rotate and cause to be rotated the connection 52 and/or 60 as appropriately installed, thereby causing the rotation of spiked driver 46 while engaged with the periphery of the ribbon disk 14 or the takeup spool 22 holding the ribbon disk 14. As the spool 22 is rotated, ribbon 20 will be pulled onto its periphery, thereby insuring that the ribbon 20 in span 18 is pulled across the span 18, thus presenting new ribbon 20 to the print point. As the diameter of the takeup spool 22 increases with the accumulation into the ribbon disk of ribbon 20, the engagement between the spiked driver 46 and the takeup spool 22 is broken as the takeup spool 22 is translated radially away from the spiked driver 46 as the ribbon disc on spool 22 grows. As the takeup spool 22 is forced away from the spiked driver 46, a similar forcing action occurs between the takeup spool 22 and the axle 24 of carrier 26. As carrier 26 is thus translated away from the spiked driver 46, spring member 40 is caused to extend through the uncoiling of coils 42 on the ends thereof. As the coils 42 uncoil and the material in the spring 40 is stressed beyond the elastic limit thereof, the force exerted on the carrier 26 remains substantially constant and is limited by the elastic limit of the spring material. When the cartridge 10 has exhausted its supply of ribbon 14 and all the ribbon has been accumulated on the takeup spool 22, the carrier 26 will have been translated to its maximum displacement position from the spiked driver 46 and the cartridge is then disposed of.

This design permits the positioning of a drive motor or ribbon feed drive connection immediately below the corner of the cartridge in such a way as to clear any correction material cartridge which may be married with it for insertion into the typewriter, while at the same time providing uniform ribbon feed and the potential for varying the feed increment for different pitches, with a simple feed mechanism.

We claim:

1. A ribbon cartridge for a printer comprising a chamber, a supply of ribbon contained within said chamber, a spool for taking up said ribbon after use, an opening for exit and entrance of said ribbon from and into said chamber to provide a span of said ribbon exterior to said chamber, a drive, drivingly engaging said spool on the periphery thereof to drive said ribbon onto said spool, a carrier for shiftably supporting said spool relative to said drive to move the axis of said spool away from said drive as used ribbon is collected on said spool, said carrier comprised of a support plane of material perpendicular to said axis of said spool, and supported and guided by the interior of said cartridge, said chamber, on one surface perpendicular to said axis of said spool, comprises a channel means for restraining, supporting and guiding said carrier for movement within said channel means with said carrier positioned with said support plane substantially parallel with said one surface and constraining said carrier for movement only away from said drive, spring means directly interconnecting said chamber and said carrier for yieldingly biasing said carrier toward said drive.

2. The cartridge of claim 1 wherein said spring means comprises a spring having a pair of terminal end portions formed into coils and an intermediate portion interconnecting said coiled terminal end portions and engaged with said carrier to impart said biasing to said carrier, said coils attached to anchors on said one surface and under stress, uncoiling to provide a substantially uniform bias to said carrier throughout its shifting movement away from said drive.

3. The cartridge of claim 1 wherein said drive comprises a coupling connection for engagement with a driving member on a ribbon drive.

4. The cartridge of claim 3 wherein said coupling connection comprises a drive reduction connection.

5. The cartridge of claim 4 wherein said drive reduction connection comprises an interiorly splined cylindrical member having spline teeth arranged around the interior cylindrical surface.

* * * * *